US007712277B2

(12) United States Patent
Swanson

(10) Patent No.: US 7,712,277 B2
(45) Date of Patent: May 11, 2010

(54) BUILDING SIDING WITH HORIZONTAL PANELS INSTALLED

(76) Inventor: Lief Eric Swanson, 3085 Mariners Way, Vero Beach, FL (US) 32963

( * ) Notice: Subject to any disclaimer, the term of this patent is extended or adjusted under 35 U.S.C. 154(b) by 0 days.

(21) Appl. No.: 11/774,247

(22) Filed: Jul. 6, 2007

(65) Prior Publication Data

US 2008/0083188 A1 Apr. 10, 2008

Related U.S. Application Data

(60) Provisional application No. 60/828,674, filed on Oct. 9, 2006.

(51) Int. Cl.
*E04D 1/00* (2006.01)

(52) U.S. Cl. ..... 52/541; 52/519; 52/523; 52/549; 52/560; 52/478

(58) Field of Classification Search ..... 52/519, 52/539, 541, 546, 560, 57, 523, 478, 553, 52/716.8, 551, 549, 518, 94–96
See application file for complete search history.

(56) References Cited

U.S. PATENT DOCUMENTS

| | | | | | |
|---|---|---|---|---|---|
| 492,736 | A | * | 2/1893 | Shull | 52/539 |
| 720,893 | A | | 2/1903 | Charlebois | |
| 1,986,739 | A | * | 1/1935 | Mitte | 52/591.4 |
| 2,241,642 | A | * | 5/1941 | McCauley | 52/539 |
| 2,831,218 | A | * | 4/1958 | Stark | 52/539 |
| 3,217,453 | A | * | 11/1965 | Medow | 52/314 |
| 3,261,136 | A | * | 7/1966 | Abner et al. | 52/471 |
| 3,304,676 | A | | 2/1967 | Sallie et al. | |
| 3,473,274 | A | | 10/1969 | Godes | |
| 4,065,899 | A | * | 1/1978 | Kirkhuff | 52/309.8 |
| 4,096,679 | A | * | 6/1978 | Naz | 52/551 |
| 4,288,958 | A | | 9/1981 | Chalmers et al. | |
| 4,308,702 | A | | 1/1982 | Rajewski | |
| 4,718,214 | A | | 1/1988 | Waggoner | |
| 5,016,415 | A | * | 5/1991 | Kellis | 52/522 |
| 5,475,960 | A | * | 12/1995 | Lindal | 52/478 |
| 5,502,940 | A | * | 4/1996 | Fifield | 52/309.12 |
| 5,634,314 | A | * | 6/1997 | Champagne | 52/712 |
| 5,675,955 | A | * | 10/1997 | Champagne | 52/521 |
| 5,694,728 | A | | 12/1997 | Heath, Jr. et al. | |
| 5,711,117 | A | * | 1/1998 | Zaccagni et al. | 52/94 |
| 5,775,042 | A | | 7/1998 | Mowery et al. | |
| 5,878,543 | A | | 3/1999 | Mowery | |
| 6,298,626 | B2 | | 10/2001 | Rudden | |
| 2004/0111990 | A1 | | 6/2004 | Neff | |

FOREIGN PATENT DOCUMENTS

| | | |
|---|---|---|
| GB | 1440327 | 6/1976 |
| WO | WO02068769 | 9/2002 |

* cited by examiner

*Primary Examiner*—David Dunn
*Assistant Examiner*—Adriana Figueroa
(74) *Attorney, Agent, or Firm*—Malin Haley DiMaggio Bowen & Lhota, P.A.

(57) ABSTRACT

Exterior building siding for aesthetic and protection of the building against wind, rain and solar energy that includes attaching each horizontal plank from the top of the wall downwardly that includes a starting strip where each plank is interlocked to the plank above it. Each of the horizontal planks includes a top wall portion that fits snuggly into an "L-shaped" groove above it so that the panels can be firmly locked together vertically in a downwardly fashion to prevent any wind uplift against the siding or moisture intrusion.

10 Claims, 5 Drawing Sheets

BUILDING SIDING WITH HORIZONTAL PANELS INSTALLED

BACKGROUND OF THE INVENTION

1. Field of the Invention

This invention relates generally to a building protective and aesthetic siding that is used to cover the exterior of a building and, specifically, to a building siding that includes horizontal planks that are interlocked together on top and bottom and that are installed from the top of a building wall in a downward direction.

2. Description of Related Art

Many buildings, residential dwellings and office buildings, use building siding on the exterior of the building for protecting the building from the elements and for aesthetic purposes. Typical building siding is constructed of a plurality of elongated, horizontal panels, planks, or strips that are typically overlapped from the wall bottom upwardly, with each next piece added that overlaps the piece below it. Such overlapping panels are used to protect the building from rain, solar and wind damage. The siding used on many residential and commercial buildings for the exterior is typically made of wooden planks that are overlapped, typically from the wall bottom upwardly. Plastic, polyvinyl chloride (PVC), and aluminum sheets have also been used. Many of these materials are also sloped to aesthetically look like wood planks that are overlapped, one on top of the other giving each plank a slight incline instead of a substantially flat surface.

One of the problems with conventional siding that is constructed with panels or planks from the wall bottom up, i.e. each horizontal plank being covered by one on top of it, is that high winds can lift a plank reducing the siding durability.

The siding described herein adds durability and protection from wind and rain because the siding planks are placed on the building from the top down. Each of the individual horizontal planks are more securely held in place because of the top and bottom interlock connections.

SUMMARY OF THE INVENTION

Exterior building siding which may be constructed of several types of materials including aluminum, polyvinyl chloride (PVC), wood, steel, concrete, hard foam or other synthetic materials having essentially two components which include: (1) a top starting strip that is affixed to the building at a selected upper beginning point of a building wall or structure and (2) a plurality of planks of the same or variable lengths that are affixed to the starting strip and to the building itself, usually to vertical studs forming the building exterior wall.

The starting strip is the uppermost horizontal strip and has an inverted "J-shaped" cross section. The strip body inverted "J-shaped" cross sectional configuration provides for a substantially upside down deep recess or groove that is disposed vertically and is tapered to receive the upper "L-shaped" lip portion of the first horizontal mounting plank. The starting strip may have a plurality of small circular recessed dimples that provide visual alignment for fasteners such as screws, nails or staples to be driven through the strip in such a manner that the head of the screw or nail is flush or countersunk below the level of the exterior surface. The strip can also be attached by glue. After the top starting strip has been fastened to the selected upper position on the building exterior wall, the horizontal siding planks are attached sequentially downwardly from the starting strip. The planks may be rectangular in shape of the same or different lengths that can be cut to make each horizontal row equal to the building wall width. Each plank has a cross section that includes a top tapered "L-shaped" area that is upright and a bottom "J-shaped" area that is inverted forming a groove. In one embodiment, the upper length of the "L-shaped" area leg of each plank is longer that the bottom portion of the "J-shaped" leg as described below.

The planks used in the siding are joined and interlocked vertically on top and bottom in horizontal rows, and are arranged in end to end abutments. The planks can be manufactured in various dimensions in terms of width or height and thickness and can be of different lengths depending on the nature of the building to be covered with siding. Each plank can be cut in length and width to fit any wall size.

The starting strip inverted "J-shaped" cross section area has a continuous groove from end to end that may be tapered and is sized to snuggly fit with the upper "L-shaped" projection of the top edge of the siding plank. Thus, when the first plank is inserted snuggly into the starting strip, there is a tight fit between both the starting strip groove and the first plank projection.

At the bottom of the every plank, there is an inverted "J-shaped" area with a groove similar to the groove inverted "J-shaped" groove in the starting strip. This plank lower groove is interlocked with the top edge of the next horizontal plank added downwardly.

The starting strip and each plank are attached to the building exterior wall surface or studs by nails, screws, staples or glue. The heads of the nail and screw fasteners may be countersunk in pre-formed recessed areas. Assembly of an exterior wall of siding begins with the attachment of the starting strip at a location that denotes the horizontal upper starting line of the siding. The starting strip is nailed, screwed, stapled or glued to the building horizontally.

A first series of planks are horizontally pushed into firm engagement in the starting strip groove and each plank is nailed, screwed, stapled or glued into place along the bottom area of each plank forming the first row of planks.

Each additional row of planks is engaged to the fastened planks downwardly, one row at a time. The fasteners securing the previous planks are covered by the next row of planks.

The planks forming the very bottom row may have to be cut longitudinally for a perfect fit to reduce their height to conform to the remaining space to be covered. These planks may be glued to the building exterior wall or studs.

In one embodiment, the inside (back) surfaces of the starting strip and all planks are flat and form a flat plane flush with the building wall or studs.

In an alternate embodiment, the back wall surface of each plank and the starting strip can include one or more vertical recessed channels (curved or rectangular in shape) that form vertical moisture or fluid conduits that allow drainage of moisture that accumulates on the outside exterior surface of the building but on the inside of the planks to dissipate moisture in the vertical channels by gravity.

Also in an alternate embodiment, the plank end faces that are placed side by side for each plank, instead of being flush, could include a groove flange overlap such that the outer surface edge of one plank overlaps the inner side edge of the adjacent planks. Between each overlap structure a small vertical space can be made as a moisture channel.

In a further alternate embodiment, the starting strip and planks can be installed onto the roof of a building as well as the soffits of a building. In this alternate embodiment, the starting strip and planks are installed in the same top-down manner as described when used for siding.

Using the present invention as described, it is noted how secure each of the individual planks are, both at the top and at the bottom, which greatly increases its durability against harsh weather elements such as wind and rain for greater strength and longer preservation.

It is an object of this invention to provide a building exterior siding that is affixed from the top down with an interlock cross sectional pattern between adjacent vertical panels to give the siding more strength and durability in use.

It is another object of this invention to provide an improved exterior panel that can be easily assembled and mounted on the exterior of a building in a top down progression for increased strength and durability of the siding.

In accordance with these and other objects which will become apparent hereinafter, the instant invention will be described with particular reference to the accompanying drawings. The figures resented in the drawings are to scale.

PREFERRED EMBODIMENT OF THE INVENTION

Figure 1:
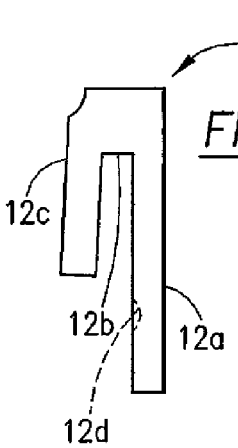
FIG. 1 shows a side elevational view of the top starter strip.
Figure 3:
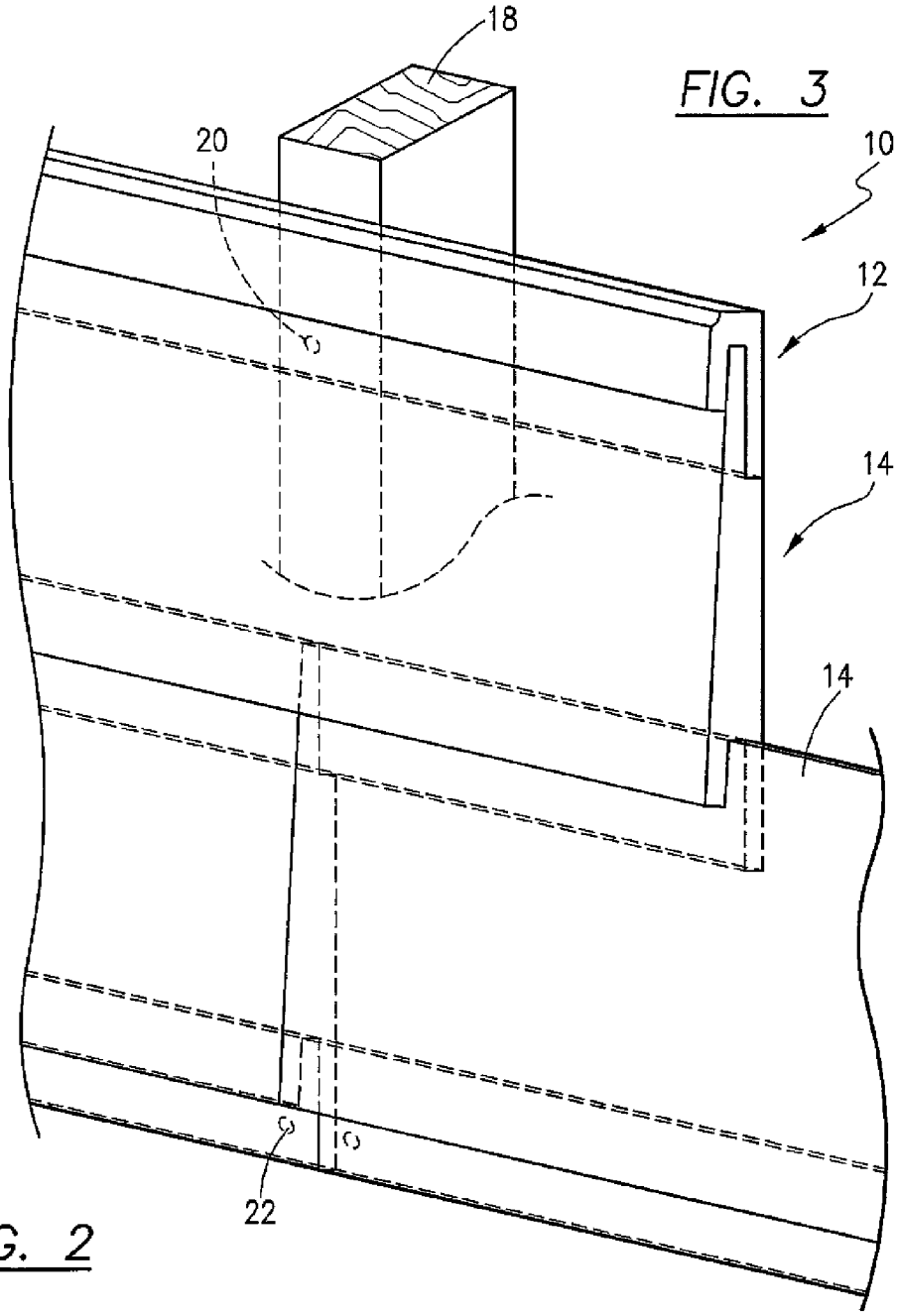
FIG. 3 shows a perspective view partially cut away of the exterior siding including the starting strip and two planks installed on the exterior of a building.

Referring now to the drawings and, particularly, FIG. 1, the starting strip 12 is shown in a side elevational view to illustrate the "J-shaped" groove that is inverted 12*b* formed between the back wall of the starting strip 12*a* and the front wall 12*c*. The starting strip 12 also includes a plurality of dimples 12*d* that are circular recessed portions sized approximately in diameter to equal to the head of a nail or a screw. However, the dimples are not required. This provides a visual indication to a construction worker as to where to insert fasteners such as nails or screws that will be countersunk when the starter strip is mounted to a vertical wall stub 18 as shown in FIG. 3.

It is further contemplated that each starting strip 12 may additionally have a plurality of shallow vertical grooves located on the flat back wall. These grooves will extend from the top of the flat back wall to the bottom of the flat back wall.

Figure 2:
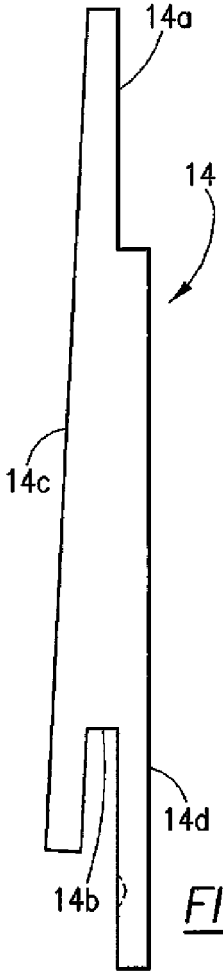
FIG. 2 shows a side elevational view of a typical horizontal plank.

Referring now to FIG. 2, the basic siding plank 14 is shown that is used to complete the building siding. Each plank 14 is mounted horizontally starting from the starter strip 12 as shown in FIG. 3 downwardly in horizontal rows. The plank 14 has a flat back wall 14*d* and an upper "L-shaped" wall 14*a* which is slightly tapered and fits substantially identical within the inverted "J-shaped" groove 12*b* of the starting strip shown in FIG. 1. It is contemplated that the structure 12 may have a "J-shape" with an interior non-parallel, tapered trapezoidal groove 12*b* to provide a tapered exterior surface. The top "L-shaped" portion 14*a* also is sized to fit substantially identical into the adjacent horizontal plank inverted "J-shaped" trapezoidal groove 14*b* as each horizontal plank is attached to the plank above it in a downward pattern. The front surface of each plank is flat but tapered to give the effect of overlapping boards and to allow water run off.

It is further contemplated that each siding plank 14 may additionally have a plurality of shallow vertical grooves located on the side of the plank 14 which will share a planar relationship with the flat back wall of the starting strip 12. These grooves will extend from the top edge to the bottom edge of the plank 14.

Looking at FIG. 3, the starting strip is shown attached to a vertical stud 18 which is the exterior wall stud for the building. Also shown in FIG. 3 are two planks 14 connected to each other vertically. The planks may have dimples 20 and 22 that are also visual representations of where to place the appropriate fasteners such as nails, screws, staples or glue when attaching each plank 14 to a vertical stud 18.

Figure 4:
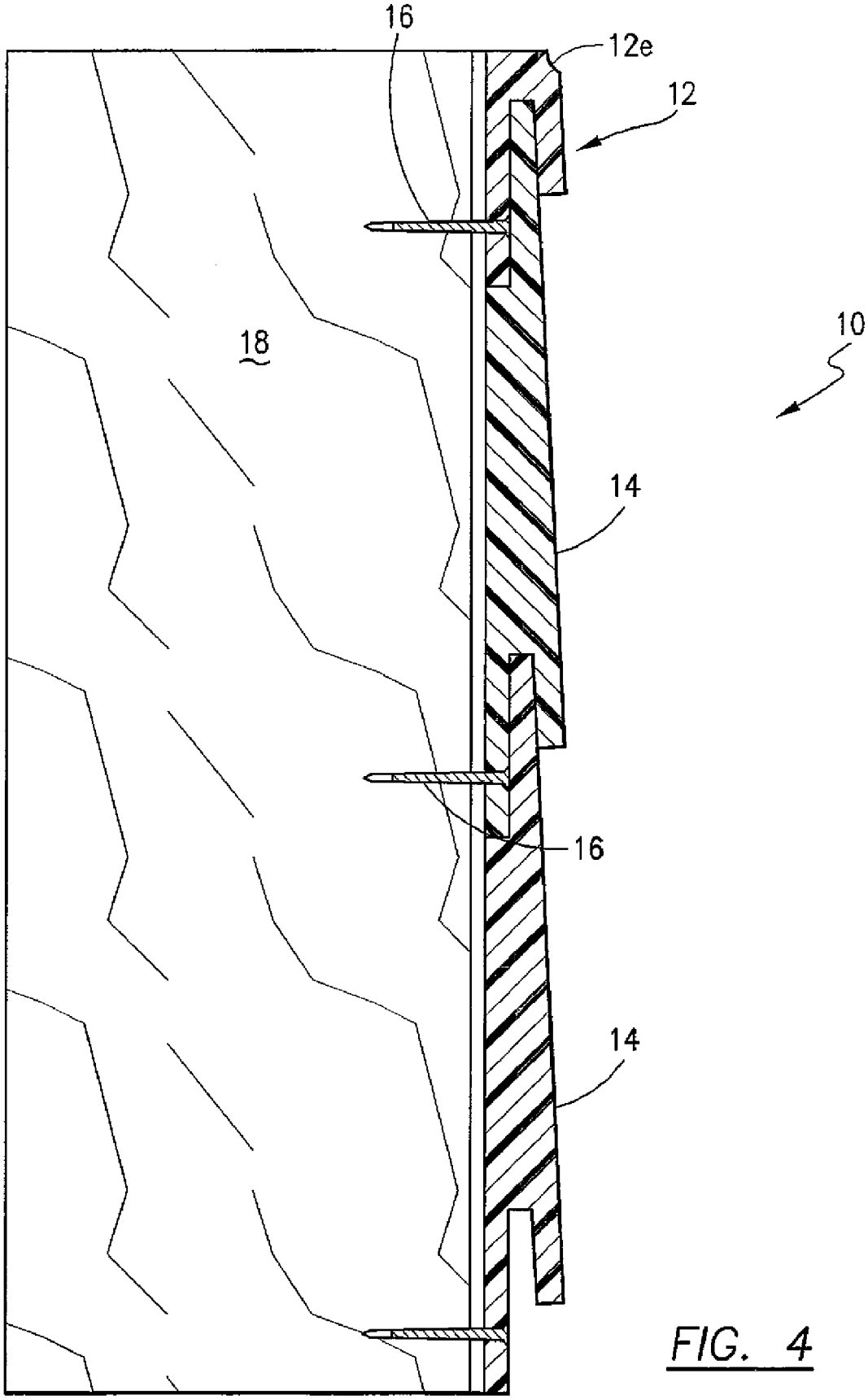
FIG. 4 shows a side elevational view partially in cross section of the building siding attached to a portion of a building wall.

Referring now to FIG. 4, the siding is shown with the starter strip 12 mounted at the top of a representative building exterior wall (unnumbered) and wall stud 18 and is interlocked with the first horizontal row plank 14 with a fastener 16 that has been attached to the starter strip 12 at the top. Subsequently, the upper trapezoidal-shaped male protrusion of the first horizontal plank 14 is pushed up into and engaged into the inverted groove in starter strip 12 at the top, with a fastener 16 at its bottom securely fastening the horizontal plank 14 to the stud 16 or building exterior wall (unnumbered) sub-sheathing which is shown applied over the stud 16. Thus, the sequence repeats itself from the top down of inserting and engaging the upper male protrusion of the next row of horizontal planks and attaching them to the stud or wall with fasteners such as nails, screws, staples or glue. The fasteners at the base of each plank are covered by the next plank being pushed up and engaged from below by the trapezoidal-shaped male protrusion 14*a* shown in FIG. 2. FIG. 4 shows starter strip 12 interlocked with plank 14, the back wall of starter strip 12 having a height less than one-half the height of lank 14.

Looking at FIGS. 3 and 4, one can easily see how strong and tight the siding is mounted on the building exterior wall. It would be difficult for the wind or rain to penetrate the siding in the interlocking configuration as shown.

Looking at FIG. 4, the top starting strip 12 can also include a decorative edge chime 12*e* if desired. Also, as shown in FIGS. 3 and 4, the horizontal planks 14 have a front façade that is visible after installation that includes a beveled or inclined shape to achieve the lap style look. However, any other façade can be utilized on the front exterior surface.

The back surfaces 12*a* and 14*d* are flat. The siding planks 14 and starting strip 12 can be made in various widths and thicknesses and lengths and from many different materials including mixed fibers, wood, concrete, steel, aluminum, plastics, polymers, foam or other blended or natural or man-made composite materials. The siding can function not only as a protective outer layer on a building protecting the building against wind, moisture, rain and solar energy, but also acts as an insulation for heat or cold. Overall, the siding provides greater uplift protection from stronger than average wind and moisture intrusion that results in a reduction of costly repairs and replacements to the building.

Figure 5:
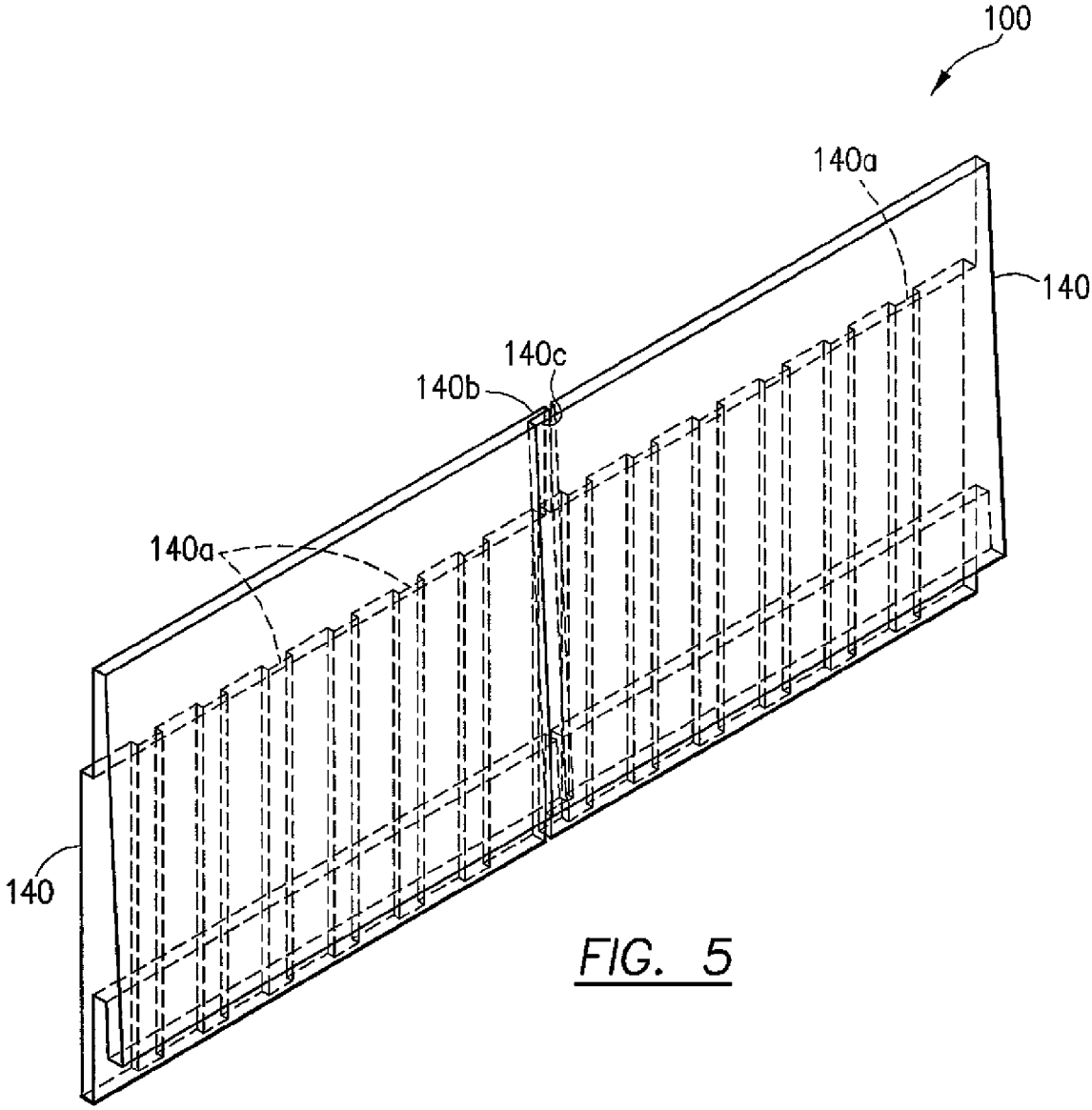
FIG. 5 shows an alternate embodiment of the invention in a perspective view with two planks joined side by side.
Figure 6:
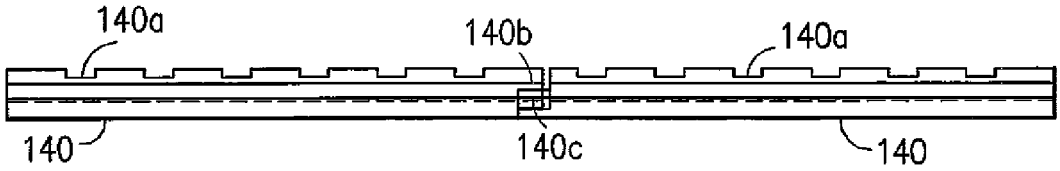
FIG. 6 shows the alternate embodiment of FIG. 5 from a top plan view.

Referring to FIGS. 5 and 6, in an alternate embodiment 100, two horizontal planks 140 are shown joined together along one edge, side by side. Each plank 140 has one or more vertical shallow channels formed in its back surface. The back surface channels can be of any cross sectional shape and are shown as rectangular. The channels are used to collect moisture that may accumulate on the exterior surface of the wall of the building being covered by the siding. As each horizontal plank row is attached to a vertical plank row above, the vertical channels 140*a* can be aligned vertically so that the plank moisture channels from the top of the wall to the bottom of the wall are aligned. The starting strip channels can also be vertically aligned. Condensate and moisture will be drained downwardly by gravity.

As shown in FIG. 6, the plank back surface channels 140*a* are shallow and rectangular grooves but could be any design or shape. Also note that in an alternate embodiment, the planks 140 can be overlapped from side to side such that one plank has an extended lip 140*c* along one edge which is sized to engage a comparable recess 140*b* in the adjacent panel along each side. Thus, the panels can be overlapped laterally for moisture prevention. Note that a small channel can be disposed along the edge that shows the overlap 140*c* and 140*b* that itself could be a moisture barrier along the inside back surface between the planks 140.

Alternate Embodiment

Figure 7B:
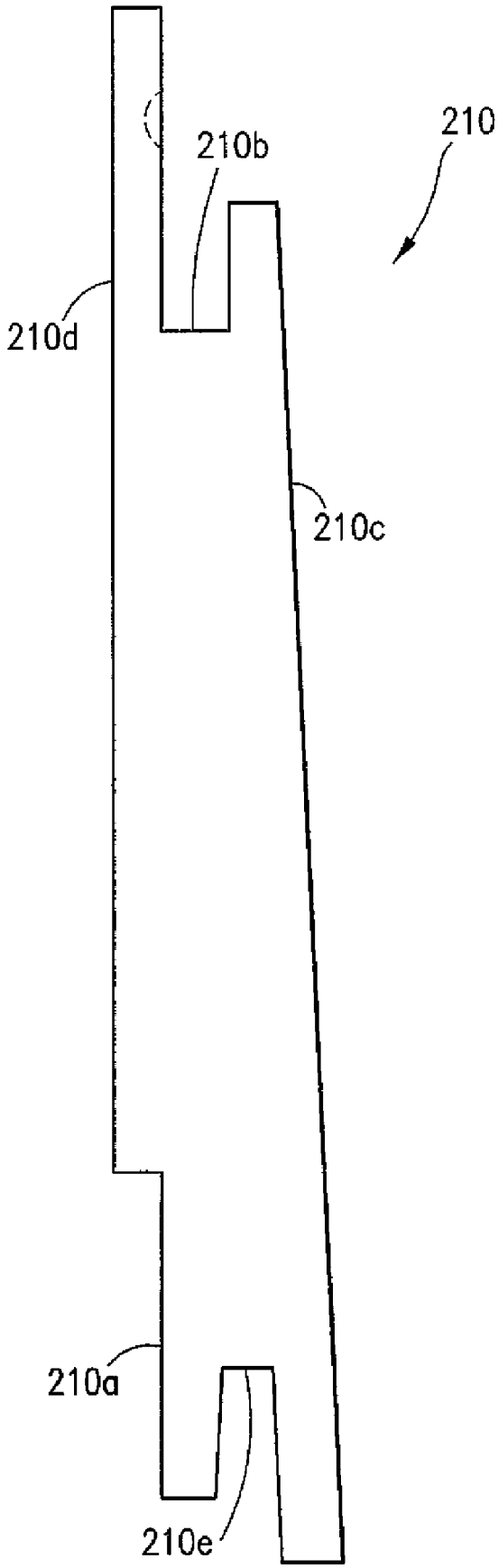
FIG. 7B shows a side elevational view of the alternate embodiment of the horizontal plank.
Figure 7A:
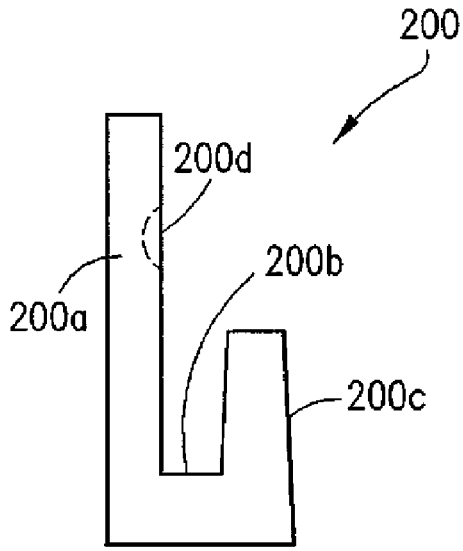
FIG. 7A shows a side elevational view of an alternate embodiment of the bottom starter strip.

As an alternative embodiment, referring now to FIG. 7A, the starting strip 200 is shown in a side elevational view to illustrate the "J-shaped" groove 200*b* formed between the back wall of the starting strip 200*a* and the front wall 200*c*. In this embodiment the starting strip 200 is installed at the bottom area of the wall to be covered. Subsequent panels 210 are then attached in an upward direction. The top plank can be attached and cut longitudinally to fit the top most row. Flashing or a sealant may be used to seal the top plank. The starting strip 200 also includes a plurality of dimples 200*d* that are circular recessed portions sized approximately in diameter to equal to the head of a nail or a screw. However, the dimples are not required. This provides a visual indication to a construction worker as to where to insert fasteners such as nails or screws that will be countersunk when the starter strip 200 is mounted to a vertical wall stub.

Each starting strip 200 may additionally have a plurality of shallow vertical grooves located on the flat back wall. These grooves will extend from the bottom of the flat back wall to the top of the flat back wall.

Referring now to FIG. 7B, the basic siding plank 210 is shown that is used to complete the building siding from the bottom of the wall upwardly. Each plank 210 is mounted horizontally starting from the starting strip 200 as shown in FIG. 7A upwardly in horizontal rows. The plank 210 has a flat back wall 210*d* and an lower inverted "J-shaped" wall 210*a* and groove 210*e* which fit snuggly within the "J-shaped" groove 200*b* of the starting strip shown in FIG. 7A. The back wall 200*a* of the starter strip 200 fits into the inverted "J-shaped" groove 210*a* of the plank 210. The front wall 200*c* of the starter strip 200 fits into the second groove 210*e* of the plank 210. The top "L-shaped" portion 210*b* of the plank 210 is sized to fit snuggly in an adjacent horizontal plank into the inverted "J-shaped" groove 210*a*, and second groove 210*e* as each horizontal plank is attached to the plank above it in an upwardly pattern. The front surface 210*c* of each plank is flat but tapered to give the effect of overlapping boards and to allow water run off.

Each siding plank 210 may additionally have a plurality of shallow vertical grooves located on the side of the plank 210 which will share a planar relationship with the flat back wall of the starting strip 200. These grooves will extend from the top edge to the bottom edge of the plank 210.

Alternate Embodiment

Figure 8:
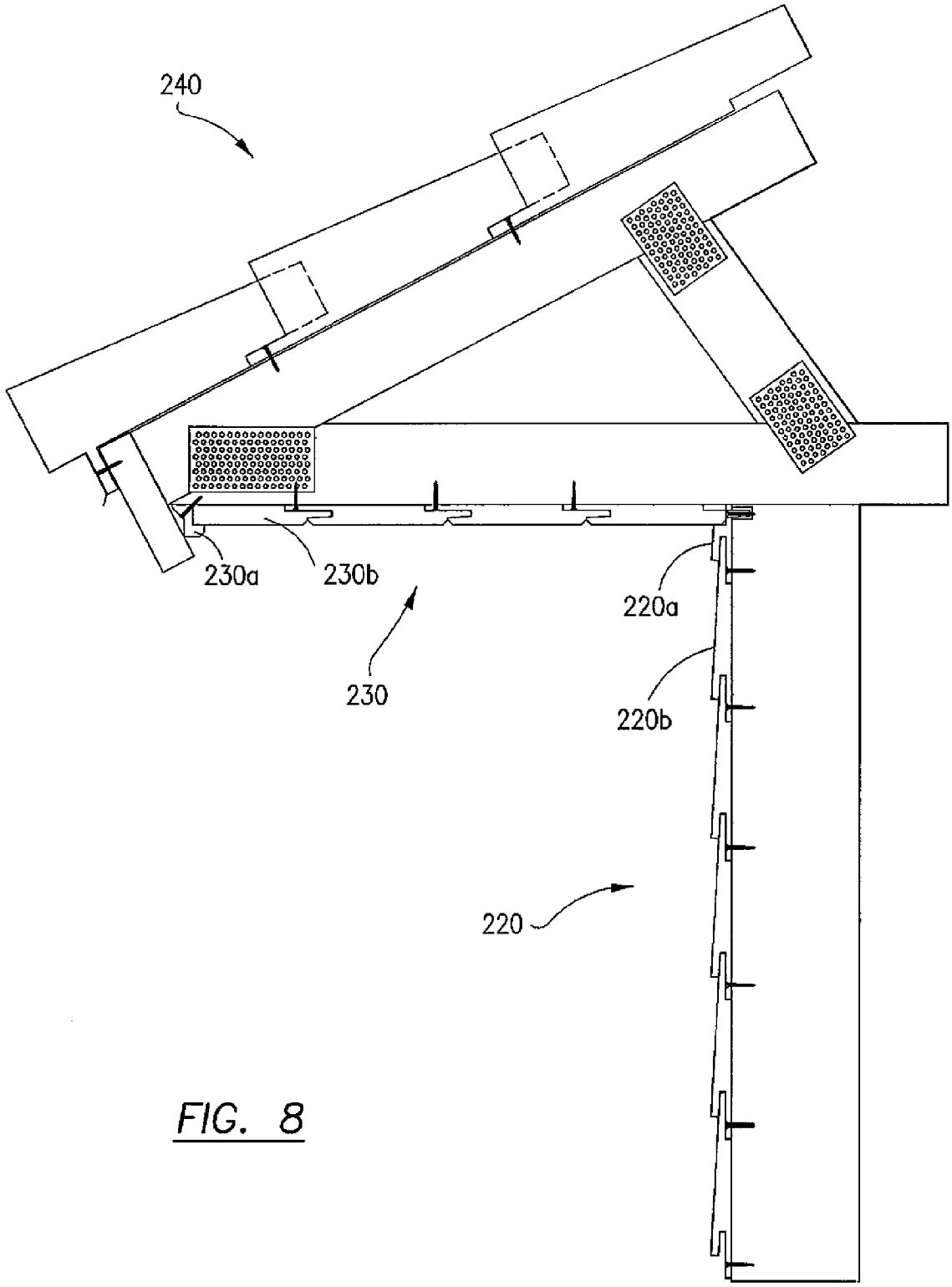
FIG. 8 shows a cross sectional view of two alternate embodiments of the building siding installed.

As an alternative embodiment, referring now to FIG. 8, the starting strip and horizontal planks 220 can also be used as soffits 230 or as roofing material 240. In both usages, the starting strip 220*a* as well as the horizontal planks 220*b* will be mounted in similar fashion to the procedure for the building siding 220. A starting strip will be mounted first. For the roofing material 240, the starting strip will be mounted near the top of the roof and the horizontal planks will be subsequently mounted below and downwardly. For the soffits 230, the starting strip 230*a* may be mounted on either side with the horizontal planks 230*b* subsequently mounted thereafter.

The instant invention has been shown and described herein in what is considered to be the most practical and preferred embodiment. It is recognized, however, that departures may be made therefrom within the scope of the invention and that obvious modifications will occur to a person skilled in the art.

What is claimed is:

1. A building siding for covering a building exterior surface that includes at least one top starter strip and a plurality of horizontally disposed planks that are interfaceable vertically from the top of the building exterior surface to the bottom of the building exterior surface to cover the exterior surface of the building comprising:

an elongated starter strip substantially rectangular in shape and having a generally "J-shaped" body in cross section including an inverted trapezoidal groove formed by the "J-shaped" cross section, said body inverted trapezoidal groove having an interior tapered shape defining an opening of a first dimension, said starter strip body having a flat back wall for attachment to-said building exterior surface;

a plurality of planks, said planks being substantially rectangular in length and width, each of said planks having a cross section that includes an upper protruding wall, trapezoidal in shape with a recessed back wall portion said upper protrusion wall having a flat end surface perpendicular to said back wall portion, said end surface having a second dimension, said second dimension being significantly less than said first dimension, the upper wall trapezoidal portion being sized to fit substantially identical into the inverted trapezoidal groove in said starter strip for interfacing, each of said planks including a lower wall having an inverted trapezoidal groove that is sized and shaped to be substantially identical to said starter strip inverted trapezoidal groove, said upper plank wall portion being interfaceable with the lower wall trapezoidal groove of an above plank, said planks being disposed horizontally in rows and interfaced in a sequence that starts at the top of the building surface and works downwardly;

said elongated starter strip having a top flat surface perpendicular to the starter strip flat back wall and a starter strip front wall and extending completely between front wall and back wall, said front wall disposed at an oblique angle to said starter strip top flat surface said starter strip inverted trapezoidal groove formed between said starter strip front wall and said starter strip flat back wall, said starter strip having a first flat bottom surface perpendicular to said starter strip front wall and disposed between said starter strip front wall and said starter strip inverted trapezoidal groove, said starter strip having a second flat bottom surface perpendicular to said starter strip flat back wall, said second flat bottom surface of said starter strip extending downwardly below the first flat bottom surface of said starter strip front wall, said starter strip flat back wall and said starter strip front wall forming said inverted trapezoidal groove between said flat back wall and said front wall, said starter strip flat back wall extending below said inverted trapezoidal groove and below said starter strip front first flat bottom surface sized for receiving one or more fasteners; and fasteners for attaching said planks to a building exterior surface attached to said plank back wall in the area extending only below said inverted trapezoidal groove formed between said plank back wall and said plank front wall.

2. The building siding described in claim 1:

wherein said flat back wall of said starter strip has a plurality of shallow vertical parallel moisture removal channels and said plank has a plurality of shallow vertical parallel moisture removal channels, said moisture removal channels of said planks aligned with said moisture removal channels of said starter strip and additional attached planks.

3. A building siding as in claim 1, wherein:

said starter strip flat top surface being mountable at the very top of a building exterior wall and securable to a building exterior wall only below the starter strip front wall by a plurality of fasteners and each of the planks being installable from the top down to an exterior building wall where said starter strip is mountable and is the selectable upper beginning point of an exterior building wall.

4. A device as in claim 1, wherein:

said fasteners include nails.

5. A device as in claim 1, wherein:

said fasteners include screws.

6. A building siding that includes at least one top starter strip and a plurality of planks that are interfaced vertically from top to bottom to cover the exterior building surface comprising:

an elongated starter strip substantially rectangular in shape and having a generally "J-shaped" body in cross section including an inverted generally trapezoidal groove formed by the "J-shaped" cross section, said starter strip body having a flat back wall for attachment to a building exterior surface, said elongated starter strip having a front wall that is obliquely angled relative to said starter strip back wall, said starter strip front wall having a flat base perpendicular to said front wall and said starter strip flat back wall extending below said starter strip front wall for receiving one or more fasteners, said starter strip front wall and said starter strip flat back wall having said inverted trapezoidal groove disposed there between; said starter strip having a substantially flat top surface perpendicular to said starter strip back wall;

at least one plank, said plank being substantially rectangular in length and width, said plank having a cross section that includes an upper protruding edge wall trapezoidal in shape, the flat upper protruding edge wall portion sized to fit and interface substantially identical into said starter strip inverted trapezoidal groove along its interior top flat edge for interfacing, said plank including a bottom edge including a lower wall also having an inverted generally trapezoidal shaped groove that is sized and shaped in thickness to be substantially identical to said starter strip trapezoidal groove, said plank upper protruding edge wall portion being interfaceable with the lower wall portion of an above plank, said planks being disposed horizontally in rows and interfaceable in a sequence that starts at the top of the wall and works downwardly;

wherein said flat back wall of said starter strip having a plurality of shallow vertical moisture removal channels and said plank having a plurality of shallow vertical moisture removal channels; said moisture removal channels of said plank aligned with said vertical moisture removal channels of said starter strip when said plank and said starter strip interlock;

said back wall of said starter strip and said back wall of each of said planks extending downwardly below said front wall of said starter strip and said wall of each of said planks respectively to have sufficient area only below said inverted trapezoidal groove for receiving a plurality of fasteners; and a plurality of elongated fasteners driven through the back walls only below said front walls of said planks and starter strips and attachable to a building surface for mounting said starter strips and siding planks.

7. A building siding for covering a building exterior surface having a plurality of horizontally disposed planks that are interfaced vertically from the top of a building exterior surface to the bottom of a building exterior surface to cover the exterior surface of a building comprising:

a plurality of planks, said planks being substantially rectangular in length and width, each of said planks having a front to back cross section that includes an upper protruding wall, having a flat top, trapezoidal in shape with a recessed back wall portion, said plank having a bottom surface including a tapered trapezoidal shaped groove, the flat top upper protruding wall trapezoidal portion being sized to fit and interface substantially identical into the inverted trapezoidal groove in said bottom surface for interfacing, said upper plank wall being interfaceable with the lower wall trapezoidal groove of an above plank, said planks being disposed horizontally in rows and interfaceable in a sequence that starts at the top of the building surface and works downwardly; and fasteners for attaching said planks to a building exterior surface attached to said plank back wall in the area extending only below said inverted trapezoidal groove formed between said plank back wall and said plank front wall.

8. A building siding as in claim 7, wherein:

a soffit starter strip having a flat back wall, a flat front wall, and a perpendicular wall connected to said flat back wall and said flat front wall, said perpendicular wall and said flat back wall and said flat front wall forming an inverted trapezoidal groove, said flat back wall having an area extending above said perpendicular wall for receiving fasteners and an area below said front wall for receiving fasteners;

said soffit starter strip and said planks capable of being mountable to a building between a facia board and a building exterior wall as a soffit siding wherein said interface between said soffit planks and a building vertical exterior wall siding plank includes a said soffit starter strip that abuts and interfaces with a plank used as a soffit siding with a said soffit starter strip that is capable of being attached at the top of a vertical wall on a building.

9. A building siding as in claim 7, including:

a soffit siding capable of being mountable horizontally and perpendicularly between a facia board and an exterior building wall, a first soffit siding starter strip mountable on one end of said soffit siding, said soffit siding starter strip including an inverted trapezoidal groove and a front oblique surface and a flat back rear surface, said soffit siding starter strip rear surface extending below and above said soffit siding starter strip front surface and said inverted trapezoidal groove for receiving fasteners;

said planks interfacing with said soffit siding starter strip and each other forming a soffit siding mountable out towards the facia board from an exterior building wall; and a finishing strip mountable at the outer edge of that interfaces with the soffit siding for trapping and locking the outside edge of the soffit siding.

10. A siding plank used for covering a building exterior surface that is interfaced vertically with other substantially identical siding planks from the top of a building exterior surface to a bottom of a building exterior surface to protect a building surface from wind and rain comprising:

a plank having a plank body substantially rectangular in shape elongated along a longitudinal axis having an indeterminate length, a predetermined height and a predetermined thickness, said plank body having ten separate individual surfaces including a first flat back surface, a lower top surface perpendicular to said first back surface, a second back surface perpendicular to said first lower top surface, a flat upper top surface perpendicular to said second back surface, said plank body having a flat front surface obliquely angled to said plank upper top surface;

said first flat back surface obliquely angled relative to said plank front surface;

said plank having a first bottom surface perpendicular to said first back surface, a second bottom surface perpendicular to said first bottom surface, a third bottom surface perpendicular to said second bottom surface;

a fourth bottom surface vertically disposed and at an oblique angle to said third bottom surface, said second bottom surface extending below and longer than said fourth bottom surface;

said fourth bottom surface obliquely angled relative to said third bottom surface, a fifth bottom surface perpendicular to said fourth bottom surface, said first bottom surface extending below said fifth bottom surface, and said fifth bottom surface perpendicular to said front plank surface, said second bottom surface sized in length to be equal to said second back surface; and said first, second, third, fourth and fifth bottom surfaces forming a trapezoidally shaped groove in the bottom of said plank, said flat upper top surface and said second back surface and said portion of said plank front surface forming a top protrusion sized to interface substantially identically in said plank bottom groove where by a plurality of substantially identical planks can be interfaced from top down to adjacent planks mounted horizontally to protect the surface of an exterior building.

* * * * *

UNITED STATES PATENT AND TRADEMARK OFFICE

CERTIFICATE OF CORRECTION

PATENT NO. : 7,712,277 B2
APPLICATION NO. : 11/774247
DATED : May 11, 2010
INVENTOR(S) : Lief Eric Swanson It is certified that error appears in the above-identified patent and that said Letters Patent is hereby corrected as shown below:

Error in column 3, line 17
"resented" should be "presented"

Error in column 3, line 54
"stub" should be "stud"

Error in column 4, line 41
"lank" should be "plank"

Error in column 5, line 41
"stub" should be "stud"

Signed and Sealed this

Twelfth Day of October, 2010

David J. Kappos

David J. Kappos
*Director of the United States Patent and Trademark Office*